US011395533B2

(12) United States Patent
Tanaka

(10) Patent No.: US 11,395,533 B2
(45) Date of Patent: Jul. 26, 2022

(54) JEWELRY BOX

(71) Applicant: Yoshiko Tanaka, Kanagawa (JP)

(72) Inventor: Yoshiko Tanaka, Kanagawa (JP)

( * ) Notice: Subject to any disclaimer, the term of this patent is extended or adjusted under 35 U.S.C. 154(b) by 0 days.

(21) Appl. No.: 17/052,975

(22) PCT Filed: May 8, 2018

(86) PCT No.: PCT/JP2018/017745

§ 371 (c)(1),
(2) Date: Nov. 4, 2020

(87) PCT Pub. No.: WO2019/215809

PCT Pub. Date: Nov. 14, 2019

(65) Prior Publication Data

US 2021/0235832 A1 Aug. 5, 2021

(51) Int. Cl.
*A45C 15/06* (2006.01)
*F21V 9/30* (2018.01)
(Continued)

(52) U.S. Cl.
CPC ..... *A45C 15/06* (2013.01); *A45C 11/16* (2013.01); *F21V 9/30* (2018.02); *F21V 23/04* (2013.01);
(Continued)

(58) Field of Classification Search
CPC . A45C 15/06; A45C 11/16; F21V 9/30; F21V 23/04; F21V 33/0028
See application file for complete search history.

(56) References Cited

U.S. PATENT DOCUMENTS 6,405,858 B1 6/2002 Gagliardi
7,325,940 B2 * 2/2008 Cea ..... A45C 11/16 206/566
(Continued)

FOREIGN PATENT DOCUMENTS

CN 202680930 U 1/2013
CN 105228293 A 1/2016
(Continued)

OTHER PUBLICATIONS

Australian Office Action issued in corresponding Australian Patent Application No. 2018422899, dated Jun. 1, 2021.
(Continued)

*Primary Examiner* — Thomas M Sember
(74) *Attorney, Agent, or Firm* — McDermott Will & Emery LLP

(57) ABSTRACT

A jewelry box includes a lower box component; a diamond supported on the lower box component and having a blue fluorescence; an upper box component hinged to the lower box component for swinging between an opened position and a closed position, the upper box component being coupled to the lower box component at the closed position for covering the diamond, the upper box component exposing the diamond at the opened position; and a light source supported on the lower part or the upper part, the light source emitting an ultraviolet radiation toward the diamond when the upper box component is moved from the closed position. This provides a jewelry box causing a most dramatic impression within an observer of the jewelry box.

11 Claims, 9 Drawing Sheets

(51) Int. Cl.

| | |
|---|---|
| ***A45C 11/16*** | (2006.01) |
| ***F21V 23/04*** | (2006.01) |
| ***F21V 33/00*** | (2006.01) |
| *F21Y 115/10* | (2016.01) |
| *F21W 121/00* | (2006.01) |

(52) U.S. Cl.
CPC ..... *F21V 33/0028* (2013.01); *F21W 2121/00* (2013.01); *F21Y 2115/10* (2016.08)

(56) References Cited

U.S. PATENT DOCUMENTS

| | | | | |
|---|---|---|---|---|
| 10,508,796 | B2 | 12/2019 | Didur | |
| 2009/0200183 | A1* | 8/2009 | Dussin | A47F 7/03 206/6.1 |
| 2016/0178168 | A1 | 6/2016 | Didur | |

FOREIGN PATENT DOCUMENTS

| | | | |
|---|---|---|---|
| CN | 205197280 | U | 5/2016 |
| CN | 106954982 | A | 7/2017 |
| EP | 2036453 | A1 | 3/2009 |
| JP | 2000-168863 | A | 6/2000 |
| JP | 2001-211922 | A | 8/2001 |
| JP | 2002-245844 | A | 8/2002 |
| JP | 2005-245912 | A | 9/2005 |
| JP | 2007-190127 | A | 8/2007 |
| JP | 2008-279227 | A | 11/2008 |
| JP | 2009-022655 | A | 2/2009 |
| JP | 2009-266672 | A | 11/2009 |
| JP | 4625409 | B2 | 2/2011 |
| JP | 3170485 | U | 9/2011 |
| KR | 20-0446748 | Y1 | 11/2009 |
| RU | 2004138576 | A | 8/2005 |
| RU | 2300095 | C2 | 5/2007 |

OTHER PUBLICATIONS

International Preliminary Report on Patentability issued in International Patent Application No. PCT/JP2018/017745, dated Jun. 12, 2020, with English translation.

International Search Report issued in corresponding International Patent Application No. PCT/JP2018/017745, dated Jul. 3, 2018, with English translation.

Notification on the results of checking the patentability of an invention issued in corresponding RU Application No. 2020140095/12 dated Jun. 10, 2021 w/Machine English Translation.

Chinese Office Action issued in corresponding CN Application No. 201880093219.7, dated Oct. 10, 2021 w/Machine English Translation.

First Examination Report issued in corresponding IN Application No. 202047052250, dated Oct. 7, 2021.

Search Report and Written Opinion issued in Singapore Patent Application No. 11202010885S dated Sep. 3, 2021.

* cited by examiner

JEWELRY BOX

CROSS REFERENCE TO RELATED APPLICATIONS

This application is the U.S. National Phase under 35 U.S.C. § 371 of International Application No. PCT/JP2018/017745, filed on May 8, 2018, the entire contents is hereby incorporated by reference.

TECHNICAL FIELD

The present invention relates to a jewelry box comprising a lower box component and an upper box component coupled to the lower box component through a hinge for swinging movement between an opened position and a closed position.

BACKGROUND ART

Japanese Patent Application No. 2005-245912 and Japanese Patent No. 4625409 respectively disclose an accessary box comprising a lower box component supporting a jewelry such as a ring, and an upper box component coupled to the lower box component through a hinge for swinging movement between an opened position and a closed position. The upper box component is configured to close the lower box component at the closed position to cover the jewelry and to open the lower box component at the opened position to expose the jewelry. An electric lamp is attached to the upper box component so as to emit a visible light toward the jewelry. A switch is connected to the electric lamp. The switch is configured to establish the supply of electric current when the upper box component swings to open the lower box component, and to break the supply of electric current when the upper box component is positioned at the closed position.

CITATION LIST

Patent Literature

Japanese Patent Application No. 2005-245912
Japanese Patent No. 4625409

SUMMARY OF THE INVENTION

Technical Problem

A normal electric lamp is utilized to emit a visible light toward the accessary supported on the lower box component in Japanese Patent Application No. 2005-245912 and Japanese Patent No. 4625409. And under normal circumstances, the natural light and a visible light from lamps fully surround the accessary box, so that the electric lamp cannot sufficiently achieve any visual performance resulting in a dramatic impact as expected.

It is accordingly an object of the invention to provide a jewelry box sufficiently generating a visual performance resulting in a dramatic impact on one who opens the jewelry box.

Solution to Problem

According to a first aspect of the invention, there is provided a jewelry box comprising: a lower box component; a diamond supported in the lower box component, the diamond having a blue fluorescence; an upper box component coupled to the lower box component through a hinge for swinging movement between an opened position and a closed position, the upper box component configured to close the lower box component at the closed position to cover the diamond and to open the lower box component at the opened position to expose the diamond; and a light source supported on the lower box component or the upper box component, the light source configured to emit ultraviolet radiation to the diamond after the upper box component is opened from the closed position.

According to a second aspect of the invention, in addition to the features of the first aspect, the light source is configured to emit radiation other than visible light.

According to a third aspect of the invention, in addition to the features of the second aspect, the light source has a directivity allowing entire radiation to be blocked with the lower box component and the upper box component.

According to a fourth aspect of the invention, there is provided a jewelry box comprising: a lower box component; a diamond supported in the lower box component, the diamond having a blue fluorescence; an upper box component coupled to the lower box component through a hinge for swinging movement between an opened position and a closed position, the upper box component configured to close the lower box component at the closed position to cover the diamond and to open the lower box component at the opened position to expose the diamond; and a light source supported on the lower box component or the upper box component, the light source configured to emit ultraviolet radiation to the diamond when a predetermined time has elapsed after the upper box component reaches the opened position.

According to a fifth aspect of the invention, in addition to the features of the fourth aspect, the light source is configured to emit radiation other than visible light.

According to a sixth aspect of the invention, in addition to the features of the fifth aspect, the light source has a directivity allowing entire radiation to be blocked with the lower box component and the upper box component.

According to a seventh aspect of the invention, there is provided a jewelry box comprising: a lower box component; a diamond supported in the lower box component, the diamond having a blue fluorescence; an upper box component coupled to the lower box component through a hinge for swinging movement between an opened position and a closed position, the upper box component configured to close the lower box component at the closed position to cover the diamond and to open the lower box component at the opened position to expose the diamond; and a light source supported on the lower box component or the upper box component, the light source configured to emit ultraviolet radiation to the diamond with an incremental intensity of the ultraviolet radiation after the upper box component reaches the opened position.

According to a eighth aspect of the invention, in addition to the features of the seventh aspect, the light source is configured to emit radiation other than visible light.

According to a ninth aspect of the invention, in addition to the features of the eighth aspect, the light source has a directivity allowing entire radiation to be blocked with the lower box component and the upper box component.

Advantageous Effects of Invention

According to the first aspect, when the upper box component is operated to at least swing from the closed position, the ultraviolet radiation is emitted toward the diamond. The diamond shines blue. The blue diamond happens to appear in the sight of one who observes the diamond. Since the blue diamond is unfamiliar, the diamond shining blue generates a dramatic impact on one who opens the jewelry box. When the diamond is picked out of the jewelry box, the diamond shines clear and white (transparent) under a visible light (the natural light or from a normal electric lamp). A sequential radiation of ultraviolet light and a visible light achieves a visual performance including a change in the color of the diamond. This type of visual performance generates a dramatic impact on one who observes the jewelry box.

According to the second aspect, since the light emitted from the light source is invisible to one who observes the diamond, the blue diamond predominates in the background, so that the dramatic impact is enhanced.

According to the third aspect, one who observes the jewelry box only catches a blue visible light transformed from the ultraviolet light based on the blue fluorescence of the diamond, and the ultraviolet light does not leak out of the jewelry box. The eyes of one who observes the jewelry box is prevented from suffering from an influence of the ultraviolet radiation.

According to the fourth aspect, when the upper box component reaches the opened position, the diamond is exposed out of the jewelry box. The diamond shines clear and white (transparent) under a visible light (the natural light or from a normal electric light). When a predetermined time has elapsed after the upper box component reaches the opened position, the ultraviolet radiation is emitted from the light source toward the diamond. The color of the diamond changes from clarity to blue. A visual performance is in this manner accomplished in response to the opening action of the jewelry box. This type of visual performance generates a dramatic impact on one who observes the jewelry box.

According to the fifth aspect, since the light emitted from the light source is invisible to one who observes the diamond, the blue diamond predominates in the background, so that the dramatic impact is enhanced.

According to the sixth aspect, one who observes the jewelry box only catches a blue visible light transformed from the ultraviolet light based on the blue fluorescence of the diamond, and the ultraviolet light does not leak out of the jewelry box. The eyes of one who observes the jewelry box is prevented from suffering from an influence of the ultraviolet radiation.

According to the seventh aspect, when the upper box component is operated to swing from the closed position, the diamond is exposed out of the jewelry box. The diamond shines clear and white (transparent) under a visible light (the natural light or from a normal electric light). When the upper box component reaches the opened position, the ultraviolet radiation is emitted from the light source toward the diamond. As the intensity of the ultraviolet radiation increases, the color of the diamond gradually changes from clarity to blue. A visual performance is in this manner accomplished in response to the opening action of the jewelry box. This type of visual performance generates a dramatic impact on one who observes the jewelry box.

According to eighth aspect, since the light emitted from the light source is invisible to one who observes the jewelry box, the blue diamond predominates in the background, so that the dramatic impact is enhanced.

According to the ninth aspect, one who observes the jewelry box only catches a blue visible light transformed from the ultraviolet light based on the blue fluorescence of the diamond, and the ultraviolet light does not leak out of the jewelry box. The eyes of one who observes the jewelry box is prevented from suffering from an influence of the ultraviolet radiation.

REFERENCE SIGNS LIST

11 . . . a jewelry box
12 . . . a lower box component
13 . . . an upper box component
23 . . . a diamond (diamond stone)
26 . . . a hinge
33 . . . a light source (LED lamp)

DESCRIPTION OF EMBODIMENTS

Embodiments of the present invention will be explained below with reference to the accompanying drawings.

Figure 1:
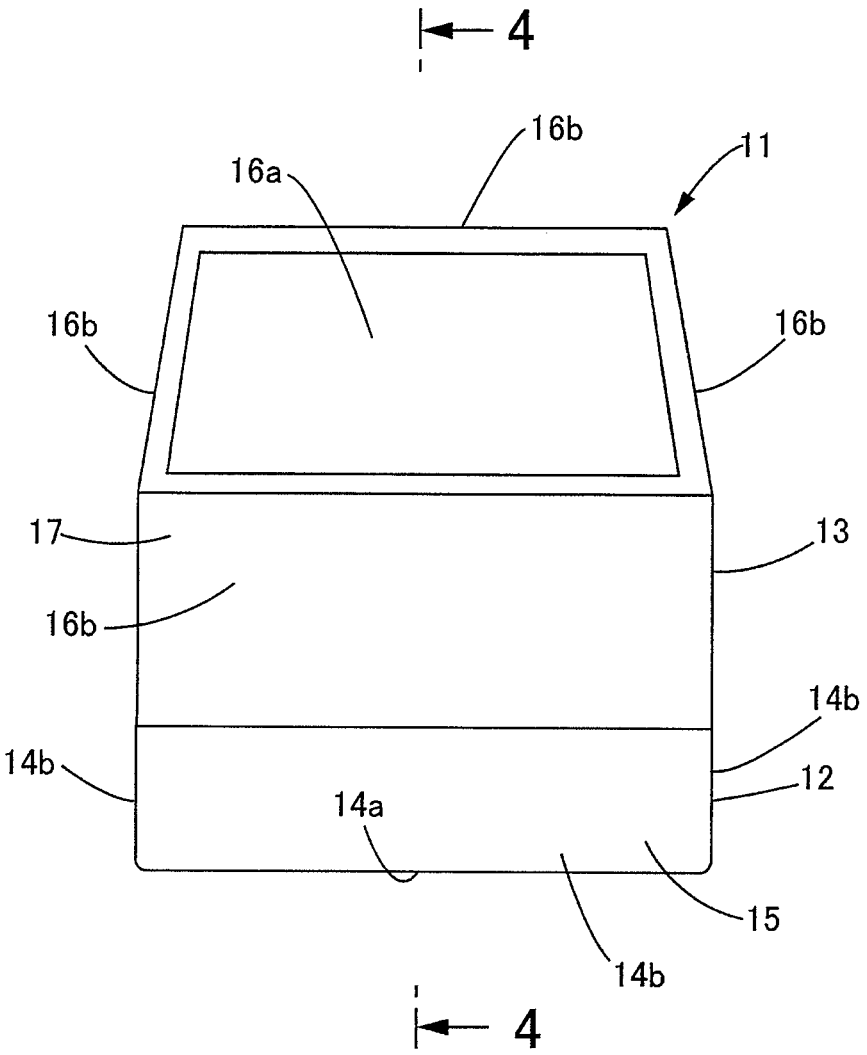
FIG. 1 is a perspective view illustrating the appearance of a jewelry box according to one embodiment of the invention.

FIG. 1 schematically illustrates a jewelry box 11 according to one embodiment of the present invention. The jewelry box 11 includes a lower box component 12 and an upper box component 13 placed on the lower box component 12 to form a rectangular parallelepiped box in combination with the lower box component 12. The lower box component 12 comprises a hard molded resin body having a bottom plate 14*a* shaped in a rectangle or square and four side walls 14*b* respectively standing at right angles from four sides of the bottom plate 14*a*, and a covering paper 15 adhered to the outer surfaces of the hard molded resin body so as to decorate the hard molded resin body. The upper box component 13 comprises a hard molded resin body having a top plate 16*a* shaped in a rectangle or square and four side walls 16*b* respectively extending downward from four sides of the top plate 16*a* to mate their lower ends with the upper end of the corresponding side walls 14*b* of the lower box component 12, and a covering paper 17 adhered to the outer surfaces of the hard molded resin body so as to decorate the hard molded resin body. The lower ends of the side walls 16*b* mate with the corresponding upper ends of the side walls 14*b* of the lower box component 12 so as to form side walls of the jewelry box 11. The covering papers 15, 17 may be a sueded paper, a cloth-like paper, or the like.

Figure 2:
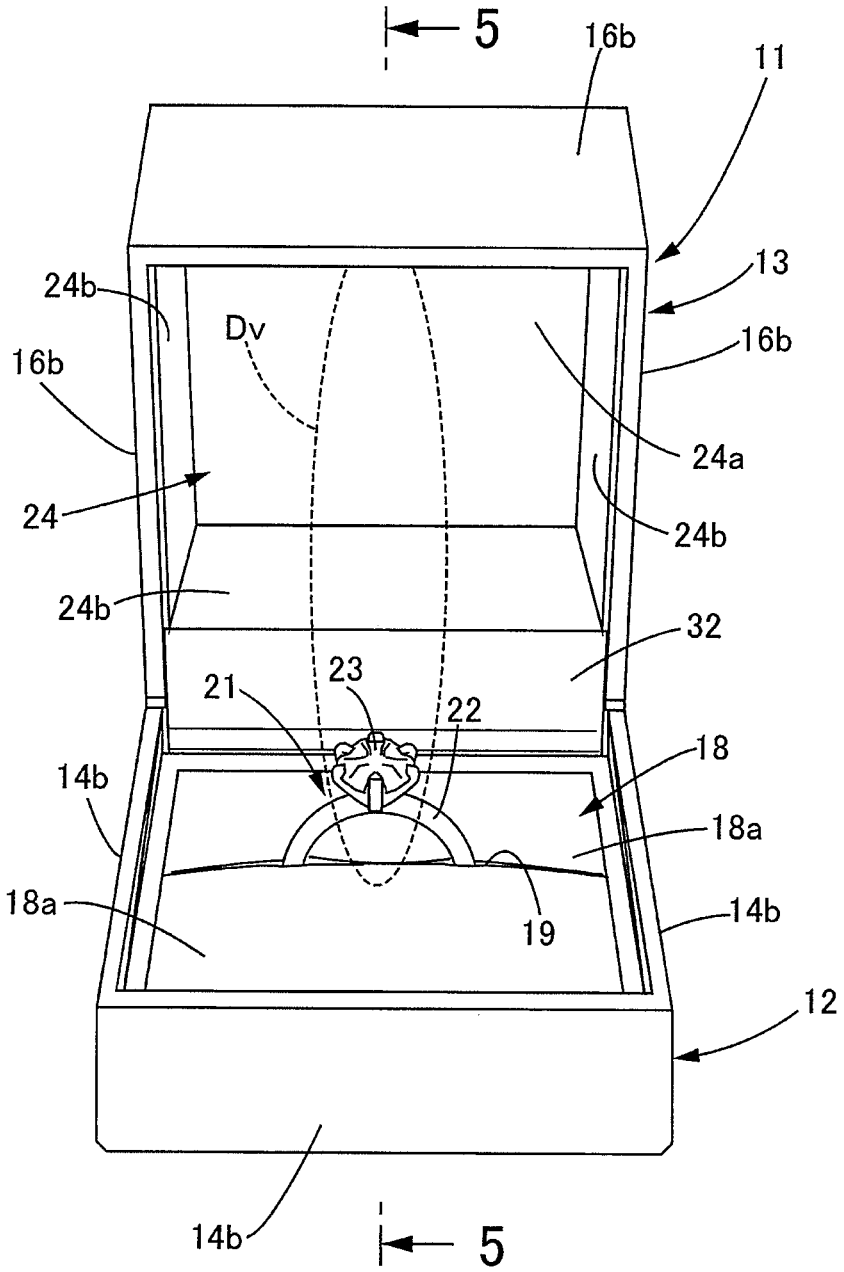
FIG. 2 is a perspective view schematically illustrating the structure of the jewelry box when the upper box component is opened.

As depicted in FIG. 2, a cushioning material 18 is fitted in a space of rectangular parallelepiped surrounded by the side walls 14*b* of the lower box component 12. The cushioning material 18 includes, for example, a sponge and a cloth 18*a* wrapping the sponge. A slit 19 is formed in the cushioning material 18. A ring 21 is inserted into the slit 19, for example. The elasticity of the cushioning material 18 serves to hold the ring 21 in the slit 19.

The ring 21 includes an annular member 22 made from platinum having an inside diameter corresponding to the size of a finger, for example, and a diamond stone 23 fixed to the mount of the annular member 22. The diamond stone 23 may be a single stone or a group of stones. The diamond stone 23 exhibits a blue fluorescence equal to or stronger than strong blue, namely, strong blue or very strong blue. The diamond stone 23 shines clear and white (transparent) under a visible light (the natural light or from a normal electric light). The diamond stone 23 shines blue under ultraviolet radiation. The diamond stone 23 is thus supported in the lower box component 12.

A ceiling member 24 is fitted in a space of rectangular parallelepiped surrounded by the side walls 16*b* of the upper box component 13. The ceiling member 24 includes a dressing top panel 24*a* shaped in a rectangle or square to form the ceiling surface of the jewelry box 11, and four side lining panels 24*b* respectively continuous from four sides of the dressing top panel 24*a* to cover over the inside surfaces of the side walls 16*b*. Here, the side lining panels 24*b* are not adhered to the inside surfaces of the side walls 16*b*, and the ceiling member 24 is detachably set inside the upper box component 13.

Figure 3:
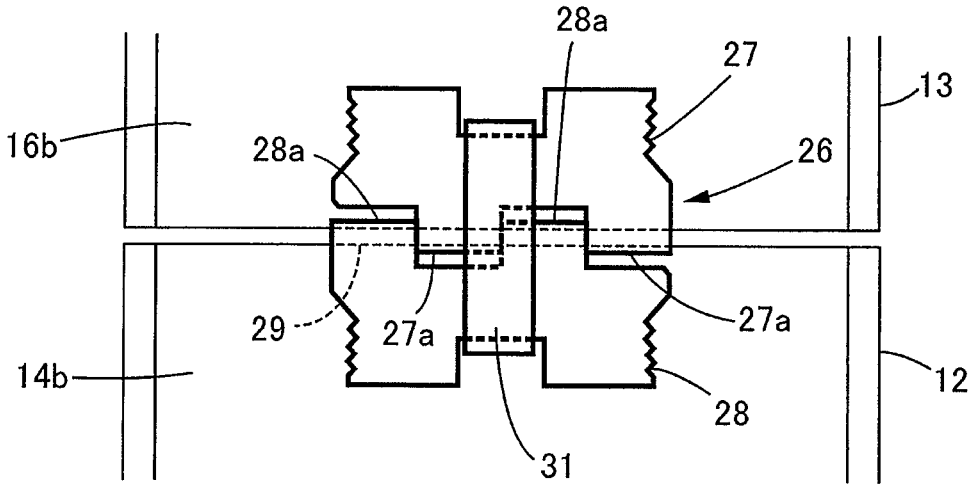
FIG. 3 is an enlarged perspective view schematically illustrating the structure of a hinge.

As depicted in FIG. 3, the upper box component 13 is coupled to the lower box component through a hinge 26 for swinging movement between an fully-opened position and a closed position. The hinge 26 includes a first hinge blade 27 overlaid and fixed on the inside surface of the side wall 16*b* of the upper box component 13, a second hinge blade 28 overlaid and fixed on the inside surface of the corresponding side wall 14*b* of the lower box component 12, and a single hinge pin 29. The first hinge blade 27 has tubes 27*a*. The second hinge blade 28 has tubes 28*a* alternated in series with the tubes 27*a* of the first hinge blade 27. The hinge pin 29 is commonly inserted into the tubes 27*a* of the first hinge blade 27 and the tubes 28*a* of the second hinge blade 28. The first hinge blade 27 swings around the hinge pin 29 relative to the second hinge blade 28.

Figure 4:
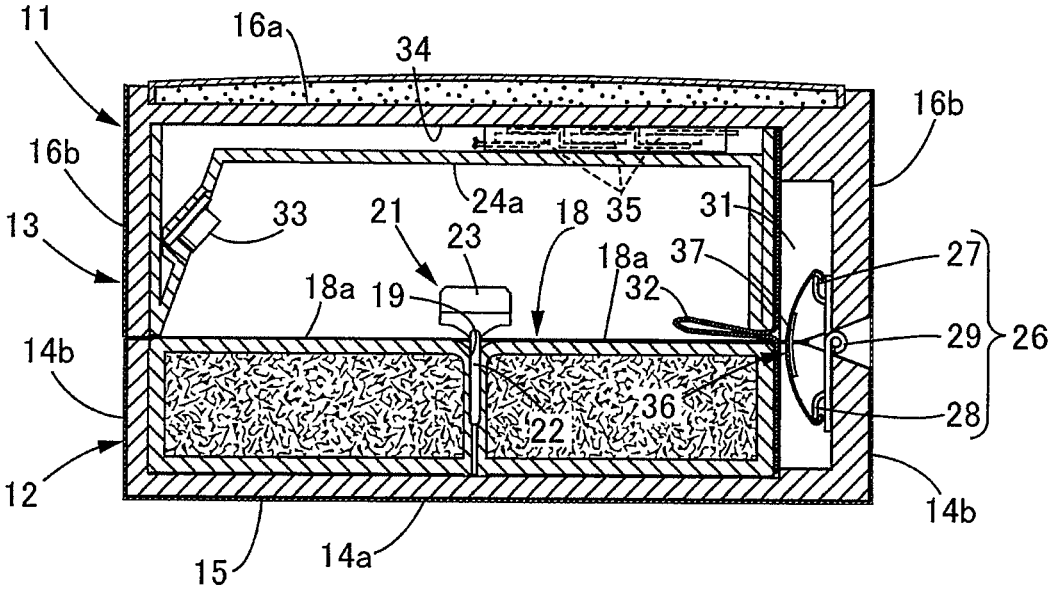
FIG. 4 is a sectional view at the vertical plane along the line 4-4 in FIG. 1
Figure 5:
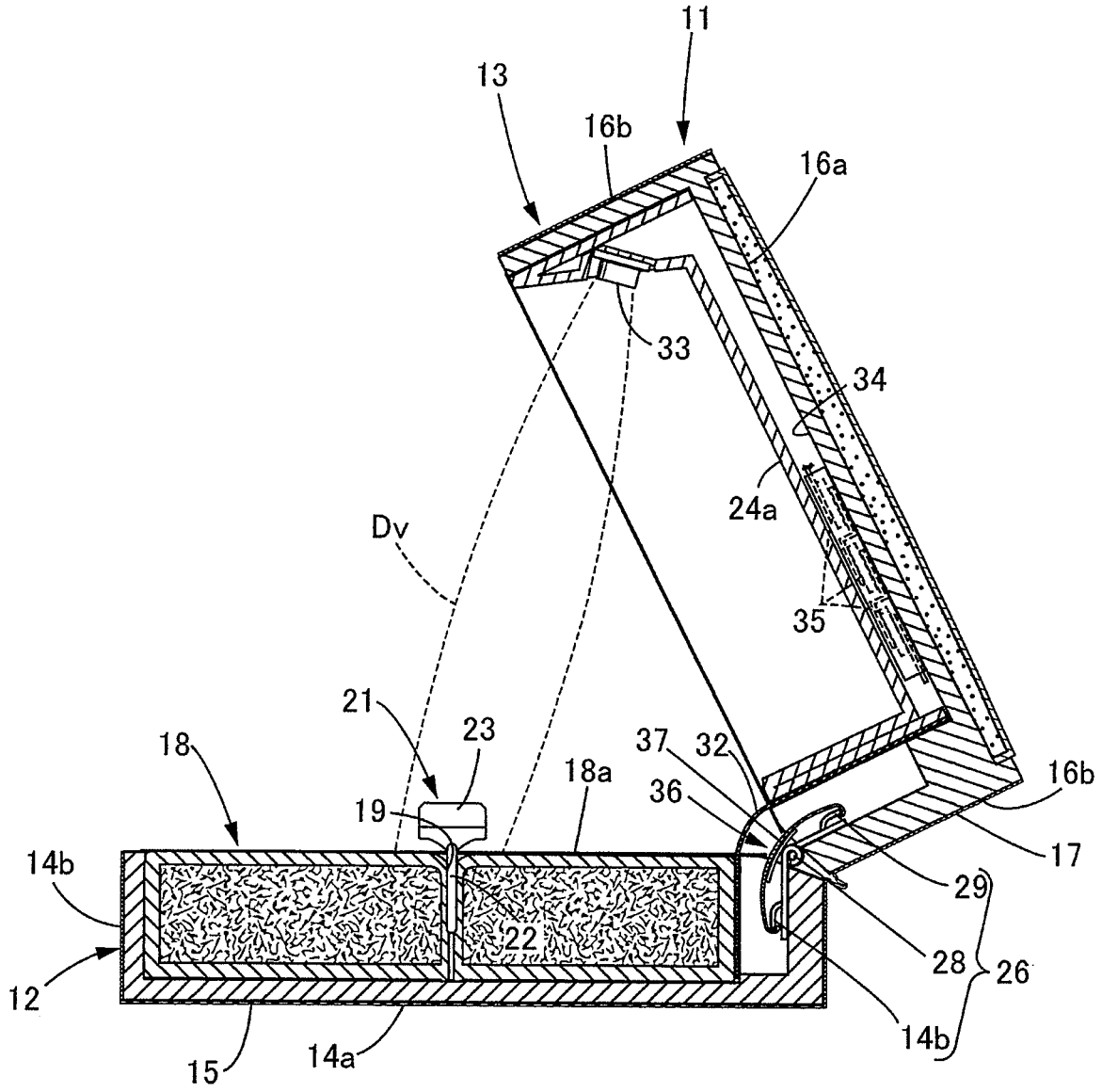
FIG. 5 is a sectional view at the vertical plane along the line 5-5 in FIG. 2.

A plate spring 31 is connected to the hinge 26. As depicted in FIG. 4, the plate spring 31 is formed in a bent plate keeping generatrices in parallel with the axis of the hinge pin 29. The opposite ends of the plate spring 31 are respectively coupled to the first hinge blade 27 and the second hinge blade 28 at locations spaced from the hinge pin 29. The first hinge blade 27 is positioned beside the second hinge blade 28 along a common provisional plane, and the intermediate section of the plate spring 31 gets furthest inward from the hinge pin 29, when the upper box component 13 takes the closed position where the lower end of the upper box component 13 is mated with the upper end of the lower box component 12. As the upper box component 13 displaces around the hinge pin 29 toward the closed position from the opened position, the outside angle reduces between the first hinge blade 27 and the second hinge blade 28 so that the intermediate section of the plate spring 31 gets closer to the hinge pin 29. As depicted in FIG. 5, when the intermediate section of the plate spring 31 contacts with the hinge pin 29, a further displacement of the upper box component 13 is restrained around the hinge pin 29 relative to the lower box component 12. The contact of the plate spring 31 with the hinge pin 29 in this manner defines the closed position of the upper box component 13. The plate spring 31 exerts the driving force to urge the upper box component 13 toward the closed position when the opening angle is smaller than a predetermined opening angle around the hinge pin 29 between the upper box component 13 and the lower box component 12. The plate spring 31 exerts the driving force to urge the upper box component 13 toward the opened position when the opening angle is larger than the predetermined opening angle around the hinge pin 29 between the upper box component 13 and the lower box component 12. A hinge cover 32 covers over the hinge 26 and the plate spring 31. The hinge cover 32 may be made of a material identical to that of the cloth 18*a* of the cushioning material 18, for example.

A light-emitting diode (LED) lamp (light source) 33 is embedded in the ceiling member 24 for the upper box component 13. The LED lamp 33 is configured to emit ultraviolet radiation based on a predetermined directivity Dv. The LED lamp 33 emits a ultraviolet light of ultraviolet A having the wavelength ranging from 315 nm to 400 nm, for example. The LED lamp 33 is preferably configured to emit radiation other than visible light. The LED lamp 33 is preferably designed to have a narrower directivity Dv. The LED lamp 33 has the directivity Dv allowing entire radiation to be blocked with the lower box component 12.

A battery 35 is connected to the LED lamp 33. The battery 35 is contained in a battery chamber 34 is defined between the top plate 16*a* of the hard molded resin body and the dressing top panel 24*a*. A thin button cell may be utilized as the battery 35, for example. Here, the button cells are connected in series, for example. Electric current is supplied to the LED lamp 33 from the battery 35.

A switch 36 is established in the hinge 26 and the plate spring 31. The switch 36 is configured to control the supply of electric current to the LED lamp 33 and the termination of the electric current. A first contact 37 is fixed to the intermediate section of the plate spring 31. The first contact 37 is insulated from the plate spring 31. The hinge 26 function as a second contact establishing the switch 36 in combination with the first contact 37. Accordingly, the hinge 26 is made of an electrically conductive material. An electrically conductive material such as copper (Cu) is used to form the first contact 37, for example. An insulating material is interposed between the first contact 37 and the plate spring 31, for example. The first contact 37 is placed on the plate spring 31 at the surface opposed to the hinge pin 29. The first contact 37 contacts with the hinge 26 when the upper box component 13 takes the opened position. The first contact 37 is spaced apart from the hinge 26 when the upper box component 13 takes a position other than the opened position.

Figure 6:
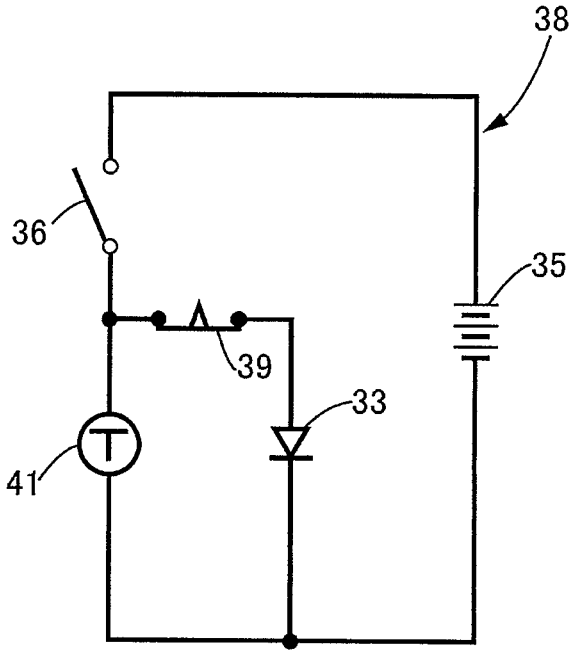
FIG. 6 is a circuit diagram of an electronic circuit according to a first example.

As depicted in FIG. 6, an electronic circuit 38 according to a first example, including the LED lamp 33, the battery 35 and the switch 36, is established in the jewelry box 11. The LED element of the LED lamp 33 is connected in series with the battery 35 in the electronic circuit 38. The switch 36 and a time-delay normally closed contact or relay 39 are connected in series with the LED lamp 33. A timer 41 is connected in parallel with the LED lamp 33 and the normally closed contact 39. When the switch 36 is closed, the LED lamp 33 lights up in response to the supply of electricity. The timer 41 starts operating concurrently with the close of the switch 36. The normally closed contact 39 opens when a predetermined time period has elapsed after the close of the switch 36. The LED lamp 33 thus blows out. When the switch 36 opens, the timer 41 returns to the initial status, and the LED lamp 33 blows out.

The LED lamp 33, the normally closed contact 39 and the timer 41 may be mounted on a common printed circuit board, for example, in the electronic circuit 38. Wires such as vinyl coated wires or cables may be utilized to electrically connect the first contact 37 of the switch 36, the first hinge blade 37 or the second hinge blade 28, the battery 35 and the like to wiring patterns on the printed circuit board. The printed circuit board may be contained within the battery chamber 34, for example.

Next, the operation of the jewelry box 11 will be described below. As depicted in FIG. 1, when the upper box component 13 is located at the closed position, the lower end of the upper box component 13 is mated with the upper end of the lower box component 12. The upper box component 13 covers over the ring 21 and buries the diamond stone 23. One who observes the jewelry box 11 looks at the exterior of the closed jewelry box 11. The diamond stone 23 is placed out of sight of one who observes the jewelry box 11.

Here, as depicted in FIG. 4, the intermediate section of the plate spring 31 gets furthest from the hinge pin 29. Accordingly, the first contact 37 of the switch 36 is spaced from the hinge 26 namely the second contact. The switch 36 opens in the electronic circuit 38.

When one who observes the jewelry box 11 manipulate the upper box component 13 toward the opened position around the hinge pin 29 against the elasticity of the plate spring 31, the lower end of the upper box component 13 gets remote from the upper end of the lower box component 12. A visible light (the natural light and from a normal electric lamp) stream in through a gap between the upper box component 13 and the lower box component 12 toward the diamond stone 23. The diamond stone 23 gradually appears in the sight of one who observes the jewelry box 11. The diamond stone 23 is exposed to the radiation of the visible light. Accordingly, the diamond stone 23 shines clear and white.

The plate spring 31 exerts the driving force to urge the upper box component 13 toward the opened position when the opening angle is larger than the predetermined opening angle around the hinge pin 29 between the upper box component 13 and the lower box component 12. The elasticity of the plate spring 31 serves to hold the upper box component 13 at the opened position. As depicted in FIG. 2, one who observes the jewelry box 11 is allowed to look at the diamond stone 23 without blockage of the upper box component 13.

When the upper box component 13 reaches the opened position, as depicted in FIG. 5, the intermediate section of the plate spring 31 is urged against the hinge 26 with the elasticity of the plate spring 31. The first contact 37 contacts with the hinge 26 namely the second contact. The switch 36 closes in the electronic circuit 38. The LED lamp 33 comes to light up. The LED lamp 33 emits ultraviolet radiation toward the diamond stone 23. The diamond stone 23 shines blue.

When the upper box component 13 swings from the closed position, the diamond stone 23 shining blue comes into the sight of one who observes the jewelry box 11. Since a blue diamond is unfamiliar, the diamond stone 23 shining blue generates a dramatic impact on one who opens the jewelry box 11. When the ring 21 is picked out of the jewelry box 11, the diamond stone 23 shines clear and white (transparent) under a visible light (the natural light or from a normal electric lamp). A sequential radiation of ultraviolet light and a visible light achieves a visual performance including a change in the color of the diamond stone 23. This type of visual performance generates a dramatic impact on one who observes the jewelry box 11.

The timer 41 starts operating in the electronic circuit 38 in response to the close of the switch 36. When the predetermined time period has elapsed after the upper box component 13 reaches the opened position, the normally closed contact 38 opens. The LED lamp 33 thus blows out. The color of the diamond stone 23 changes from blue to transparency (white) after the diamond stone 23 shining blue has been observed awhile subsequent to the opening of the upper box component 13. When the upper box component 13 is closed from the opened position, the switch 36 opens and the LED lamp 33 blows out.

Here, the LED lamp 33 is configured to emit radiation other than visible light. Accordingly, the light emitted from the LED lamp 33 is invisible to one who observes the jewelry box 11. The blue diamond stone 23 predominates in the background, so that the dramatic impact is enhanced.

The LED lamp 33 has the directivity Dv allowing the entire radiation to be blocked with the lower box component 12. One who observes the jewelry box 11 only catches a blue visible light transformed from the ultraviolet light based on the blue fluorescence of the diamond stone 23, and the ultraviolet light does not leak out of the jewelry box 11. The eyes of one who observes the jewelry box 11 is prevented from suffering from an influence of the ultraviolet radiation.

A normally closed momentary switch (tact switch) may be employed in the electronic circuit 38 in place of the switch 36. The momentary switch opens the contacts when the upper box component 13 is overlaid on the lower box component 12 at the closed position. When the upper box component 13 displaces from the closed position, the LED lamp 33 lights up after a predetermined time has elapsed corresponding to the stroke of the momentary switch. The diamond stone 23 shining blue comes to appear in the sight of one who observes the jewelry box 11 concurrent with the opening of the upper box component 13. Since a blue diamond is unfamiliar, the diamond stone 23 shining blue generates a dramatic impact on one who opens the jewelry box 11. When the diamond stone 23 is picked out of the jewelry box 11, the diamond stone 23 shines clear and white (transparent) under a visible light (the natural light or from a normal electric lamp). A sequential radiation of ultraviolet light and a visible light achieves a visual performance including a change in the color of the diamond stone 23. This type of visual performance generates a dramatic impact on one who observes the jewelry box 11.

Figure 7:
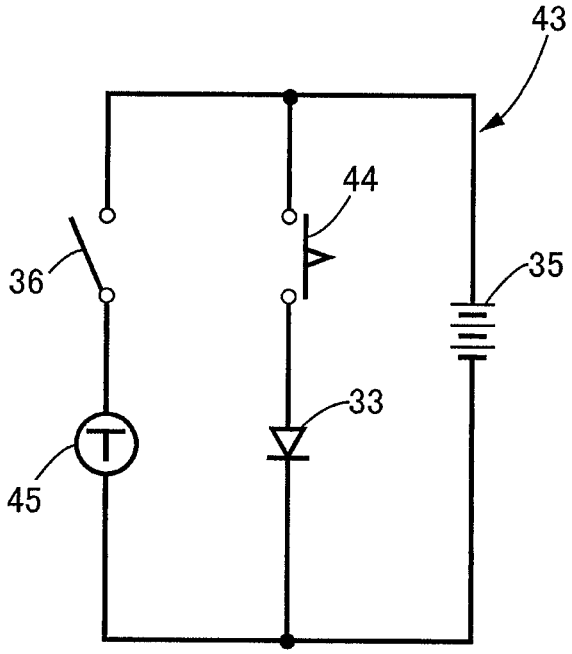
FIG. 7 is a circuit diagram of an electronic circuit according to a second example.

FIG. 7 schematically illustrates the structure of an electronic circuit 43 according to a second example. The LED element of the LED lamp 33 is connected in series with the battery 35 in the electronic circuit 43. A time-delay normally open contact 44 is connected in series with the LED lamp 33. The switch 36 and a timer 45 are connected in parallel with the LED lamp 33 and the normally open contact 44. When the switch 36 is closed, the timer starts to operate, and the normally open contact 44 closes after a predetermined time has elapsed. The LED lamp 33 thus blows out. When the switch 36 opens, the timer 45 returns to the initial status, the normally open contact 44 opens. The LED lamp 33 thus blows out.

The LED lamp 33, the normally open contact 44 and the timer 45 may be mounted on a common printed circuit board, for example, in the electronic circuit 43. Wires such as vinyl coated wires or cables may be utilized to electrically connect the first contact 37 of the switch 36, the first hinge blade 37 or the second hinge blade 28, the battery 35 and the like to wiring patterns on the printed circuit board. The printed circuit board may be contained within the battery chamber 34, for example.

When the upper box component 13 reaches the opened position, even though the switch 36 closes in the electronic circuit 43, the LED lamp 33 is suspended from lighting until a predetermined time period elapses. As depicted in FIG. 2, one who observes the jewelry box 11 is allowed to look at the diamond stone 23 shining clear and white without blockage of the upper box component 13. When the predetermined time period has elapsed after the close of the switch 36, the LED lamp 33 lights up. The LED lamp 33 emits ultraviolet radiation toward the diamond stone 23. The diamond stone 23 shines blue. The color of the diamond stone 23 changes from transparency (white) to blue after the diamond stone 23 shining clear and white has been observed awhile subsequent to the opening of the upper box component 13. A visual performance is in this manner accomplished in response to the opening action of the upper box component 13. This type of visual performance generates a dramatic impact on one who observes the jewelry box. When the switch 36 is opened, the LED lamp 33 blows out.

Here, the LED lamp 33 is configured to emit radiation other than visible light. Accordingly, the light emitted from the LED lamp 33 is invisible to one who observes the diamond stone 23. The blue diamond stone 23 predominates in the background, so that the dramatic impact is enhanced.

The LED lamp 33 has the directivity Dv allowing the entire radiation to be blocked with the lower box component 12. One who observes the jewelry box 11 only catches a blue visible light transformed from the ultraviolet light based on the blue fluorescence of the diamond stone 23, and the ultraviolet light does not leak out of the jewelry box 11. The eyes of one who observes the jewelry box 11 is prevented from suffering from an influence of the ultraviolet radiation.

Figure 8:
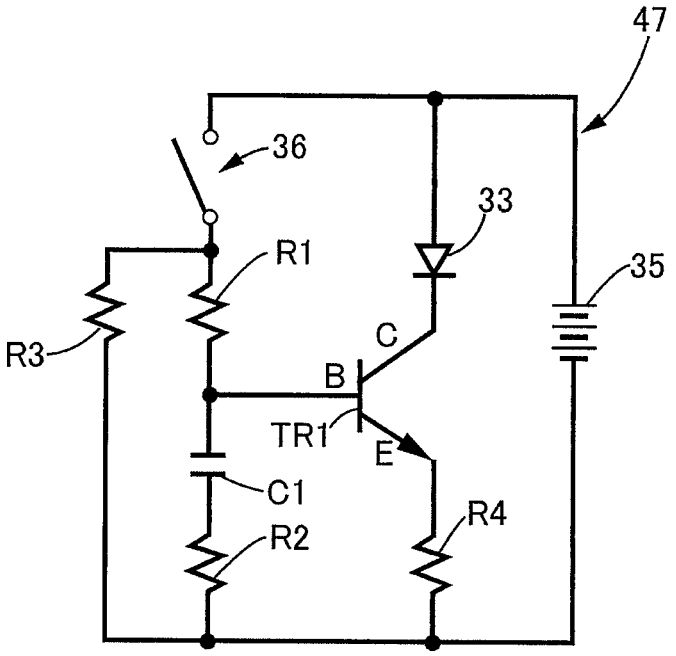
FIG. 8 is a circuit diagram of an electronic circuit according to a third example.

FIG. 8 schematically illustrates the structure of an electronic circuit 47 according to a third example. The electronic circuit 47 includes an NPN transistor TR1 connected to the battery 35. The LED element of the LED lamp 33 is connected between the positive terminal of the battery 35 and the collector C of the NPN transistor TR1. The switch 36 and a first resistor R1 in series are connected between the positive terminal of the battery 35 and the base B of the NPN transistor TR1. A capacitor C1 and a second resistor R2 in series are connected to the base B of the NPN transistor TR1 and the negative terminal of the battery 35. A third resistor R3 is connected in parallel with the first resistor R1, the capacitor C1 and the second resistor R2. A fourth resistor R4 is connected between the emitter E of the NPN transistor TR1 and the negative terminal of the battery 35. When the switch 36 is closed in the electronic circuit 47, the second resistor R2 serves to allow the supply of electric voltage exceeding a predetermined threshold to the base B of the NPN transistor TR1. Accordingly, the electric current immediately flows into the collector C of the NPN transistor TR1. The time constant circuit R1, C1 serves to gradually increase the electric voltage applied to the base B of the NPN transistor TR1. When a predetermined time has elapsed, the applied voltage is maintained constant at the base B of the NPN transistor TR1. When the switch 36 is opened, the charge of the capacitor C1 is released through the third resistor R3.

The LED lamp 33, the NPN transistor TR1. The capacitor C1, and the first to fourth resistors R1, R2, R3, R4 may be mounted on a common printed circuit board, for example, in the electronic circuit 47. Wires such as vinyl coated wires or cables may be utilized to electrically connect the first contact 37 of the switch 36, the first hinge blade 37 or the second hinge blade 28, the battery 35 and the like to wiring patterns on the printed circuit board. The printed circuit board may be contained within the battery chamber 34, for example.

When the upper box component 13 reaches the opened position, the switch 36 closes in the electronic circuit 47. The electric voltage is applied to the base B of the NPN transistor TR1 from the battery 35 in response to the close of the switch 36. The electric current flows into the base B of the NPN transistor TR1, so that the LED lamp 33 starts lighting up.

The time constant circuit R1, C1 serves to gradually increase the electric voltage applied to the base B of the NPN transistor TR1. The amount of electric current gradually increases through the LED lamp 33. The LED lamp 33 correspondingly acts to increase the intensity of the ultraviolet radiation to the diamond stone 23. The color of the diamond stone 23 gradually changes from white (clarity) to blue. A visual performance is in this manner accomplished in response to the opening action of the upper box component 13. This type of visual performance generates a dramatic impact on one who observes the jewelry box 11. When the switch 36 is opened, the charge of the capacitor C1 is released through the third resistor R3.

Here, the LED lamp 33 is configured to emit radiation other than visible light. Accordingly, the light emitted from the LED lamp 33 is invisible to one who observes the diamond stone 23. The blue diamond stone 23 predominates in the background, so that the dramatic impact is enhanced.

The LED lamp 33 has the directivity Dv allowing the entire radiation to be blocked with the lower box component 12. One who observes the jewelry box 11 only catches a blue visible light transformed from the ultraviolet light based on the blue fluorescence of the diamond stone 23, and the ultraviolet light does not leak out of the jewelry box 11. The eyes of one who observes the jewelry box 11 is prevented from suffering from an influence of the ultraviolet radiation.

Figure 9:
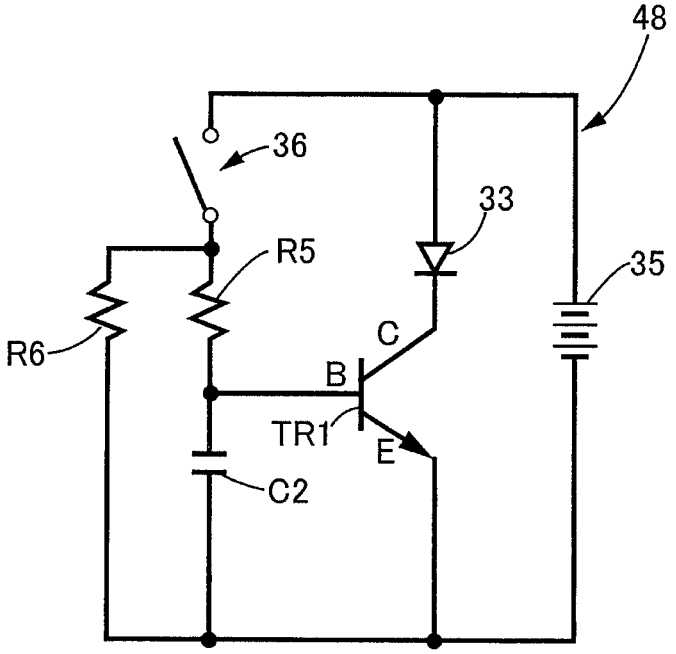
FIG. 9 is a circuit diagram of an electronic circuit according to a fourth example.

FIG. 9 schematically illustrates the structure of an electronic circuit 48 according to a fourth example. The electronic circuit 48 includes an NPN transistor TR1 connected to the battery 35. The LED element of the LED lamp 33 is connected between the positive terminal of the battery 35 and the collector C of the NPN transistor TR1. The switch 36 and a first resistor R5 in series are connected between the positive terminal of the battery 35 and the base B of the NPN transistor TR1. A capacitor C2 is connected between the base B of the NPN transistor TR1 and the negative terminal of the battery 35. A second resistor R6 is connected in parallel with the first resistor R5 and the capacitor C2. The emitter E of the NPN transistor TR1 is connected to the negative terminal of the battery 35. When the switch 36 is closed in the electronic circuit 48, the time constant circuit R5, C2 serves to gradually increase the electric voltage applied to the base B of the NPN transistor TR1. When the voltage reaches a predetermined threshold at the base B of the NPN transistor TR1, the electric current flows into the collector C of the NPN transistor TR1. When the predetermined time has subsequently elapsed, the applied voltage is maintained constant at the base B of the NPN transistor TR1. When the switch 36 is opened, the charge of the capacitor C2 is released through the second resistor R6.

The LED lamp 33, the NPN transistor TR1. The capacitor C2, and the first and second resistors R5, R6 may be mounted on a common printed circuit board, for example, in the electronic circuit 47. Wires such as vinyl coated wires or cables may be utilized to electrically connect the first contact 37 of the switch 36, the first hinge blade 37 or the second hinge blade 28, the battery 35 and the like to wiring patterns on the printed circuit board. The printed circuit board may be contained within the battery chamber 34, for example.

When the upper box component 13 reaches the opened position so that the switch 36 closes in the electronic circuit 48, the predetermined voltage is applied to the base B of the NPN transistor TR1 from the battery 35 after a predetermined time has elapsed subsequent to the close of the switch 36. This causes the electric current to flow into the collector C of the NPN transistor TR1. The LED lamp 33 correspondingly starts to light up. Accordingly, one who observes the jewelry box 11 is allowed to enjoy the diamond stone 23 shining clear and white (transparent) awhile subsequent to the opening of the upper box component 13.

The time constant circuit R5, C2 serves to gradually increase the electric voltage applied to the base B of the NPN transistor TR1. The amount of electric current gradually increases through the LED lamp 33. The LED lamp 33 correspondingly acts to increase the intensity of the ultraviolet radiation to the diamond stone 23. The color of the diamond stone 23 gradually changes from white (clarity) to blue. A visual performance is in this manner accomplished in response to the opening action of the upper box component 13. This type of visual performance generates a dramatic impact on one who observes the jewelry box 11. When the switch 36 is opened, the charge of the capacitor C2 is released through the second resistor R6.

It should be noted that the lower box component 12 may be configured to support the LED lamp 33 in place of the upper box component 13. In this case, the LED lamp 33 may have the directivity Dv allowing the entire radiation to be blocked with the upper box component 13. In addition, the diamond stone 23 may be mounted on each of mounts constituting a chain of a necklace. The mount may be formed of a metallic material such as platinum, gold or the like. Single piece of diamond stone 23 or pieces of diamond stone 23 may be fixed to the individual mount of the necklace. The diamond stone 23 may be mounted on a pendant, a bracelet, a pierced earring, a ring, an anklet, or the like. A group of diamond stone 23 may include pieces of a constant size or pieces of different sizes.

The jewelry box 11 may include, as the switch 36, a tact switch having a plunger which the upper box component 13 pushes down when the upper box component 13 reaches the opened position. The electronic circuit 38 of the first example and the electronic circuit 43 of the second example may be replaced with any other types of electronic circuit unless such an electronic circuit realizes the identical function. The action of the switch 36 may be interlocked not only with the upper box component 13 assuming the opened position in the aforementioned manner but also with the upper box component assuming the closed position. And the function of the electronic circuit 38, 43, 47, 48 may be realized with the implementation of a software in a microprocessor (MPU).

The invention claimed is:

1. A jewelry box comprising:

a lower box component;

a diamond supported in the lower box component, the diamond having a blue fluorescence;

an upper box component coupled to the lower box component through a hinge for swinging movement between an opened position and a closed position, the upper box component configured to close the lower box component at the closed position to cover the diamond and to open the lower box component at the opened position to expose the diamond;

a spring member connected to the lower box component and the upper box component and exerting a driving force to bring the upper box component into the opened position; and a light source supported on the lower box component or the upper box component, wherein when a predetermined period of time has elapsed after the upper box component reaches the opened position, the light source is configured to start emission of ultraviolet radiation to the diamond such that upon the upper box component reaching the opened position, the light source does not emit the ultraviolet radiation for the predetermined period of time.

2. The jewelry box according to claim 1, further comprising a timer configured to operate concurrently with close of a switch when the upper box component has reached the opened position.

3. The jewelry box according to claim 2, wherein the light source is configured to keep the ultraviolet radiation until the upper box component is closed from the opened position.

4. The jewelry box according to claim 3, wherein the light source is configured to emit the ultraviolet radiation to the diamond with an incremental intensity.

5. The jewelry box according to claim 2, wherein the light source is configured to emit the ultraviolet radiation to the diamond with an incremental intensity.

6. The jewelry box according to claim 1, wherein the light source is configured to emit the ultraviolet radiation to the diamond with an incremental intensity.

7. The jewelry box according to claim 1, wherein the opened position of the upper box component is a fully-opened position.

8. A jewelry box comprising:

a lower box component;

a diamond supported in the lower box component, the diamond having a blue fluorescence;

an upper box component coupled to the lower box component through a hinge for swinging movement between an opened position and a closed position, the upper box component configured to close the lower box component at the closed position to cover the diamond and to open the lower box component at the opened position to expose the diamond;

a spring member connected to the lower box component and the upper box component and exerting a driving force to bring the upper box component into the opened position; and a light source supported on the lower box component or the upper box component, wherein when the upper box component has reached the opened position, the light source is configured to start emission of ultraviolet radiation to the diamond with an incremental intensity of the ultraviolet radiation, and wherein the incremental intensity of the ultraviolet radiation starts at a first intensity at which the diamond appears colorless and is incrementally increased, as a period of the upper box component being in the opened position increases, to a second intensity at which the diamond appears blue.

9. The jewelry box according to claim 8, further comprising a time constant circuit configured to gradually increase intensity of the ultraviolet radiation in response to close of a switch after the upper box component has reached the opened position.

10. The jewelry box according to claim 9, wherein the light source is configured to keep the intensity of the ultraviolet radiation after the intensity of the ultraviolet radiation has increased.

11. The jewelry box according to claim 8, wherein the opened position of the upper box component is a fully-opened position.

* * * * *